United States Patent [19]

Quinnell

[11] Patent Number: 4,610,622

[45] Date of Patent: Sep. 9, 1986

[54] METHOD AND APPARATUS FOR IGNITING FLARE GAS

[76] Inventor: John O. Quinnell, Box 4095, Skaar Rte., Sidney, Mont. 59270

[21] Appl. No.: 659,488

[22] Filed: Oct. 10, 1984

[51] Int. Cl.[4] ..... F23D 14/00

[52] U.S. Cl. ..... 431/5; 431/202; 431/284

[58] Field of Search ..... 431/202, 5, 284, 285

[56] References Cited

U.S. PATENT DOCUMENTS

| | | | |
|---|---|---|---|
| 2,460,016 | 1/1949 | Kuhn | 431/202 X |
| 3,289,729 | 12/1966 | Reed | 431/202 |
| 3,606,611 | 9/1971 | Wright | 431/202 |
| 3,932,111 | 1/1976 | Liknes et al. | 431/202 |
| 4,118,173 | 10/1978 | Shakiba | 431/202 |
| 4,188,183 | 2/1980 | Zink et al. | 431/202 |
| 4,468,193 | 8/1984 | Lawrence et al. | 431/202 X |
| 4,516,932 | 5/1985 | Chaudot | 431/202 |

*Primary Examiner*—Randall L. Green

*Attorney, Agent, or Firm*—Pollock, Vande Sande & Priddy

[57] ABSTRACT

An apparatus and method are disclosed for igniting flare gas at an oil well or refinery, in which a flow of gas is directed into an expansion chamber where expansion and condensation take place, after which the gas moves upwardly within the chamber and past an aperture in the chamber sidewall where a portion of the gas is withdrawn for ignition outside the chamber to form a pilot flame which ignites the remainder of the gases exiting from the open top of the chamber.

25 Claims, 1 Drawing Figure

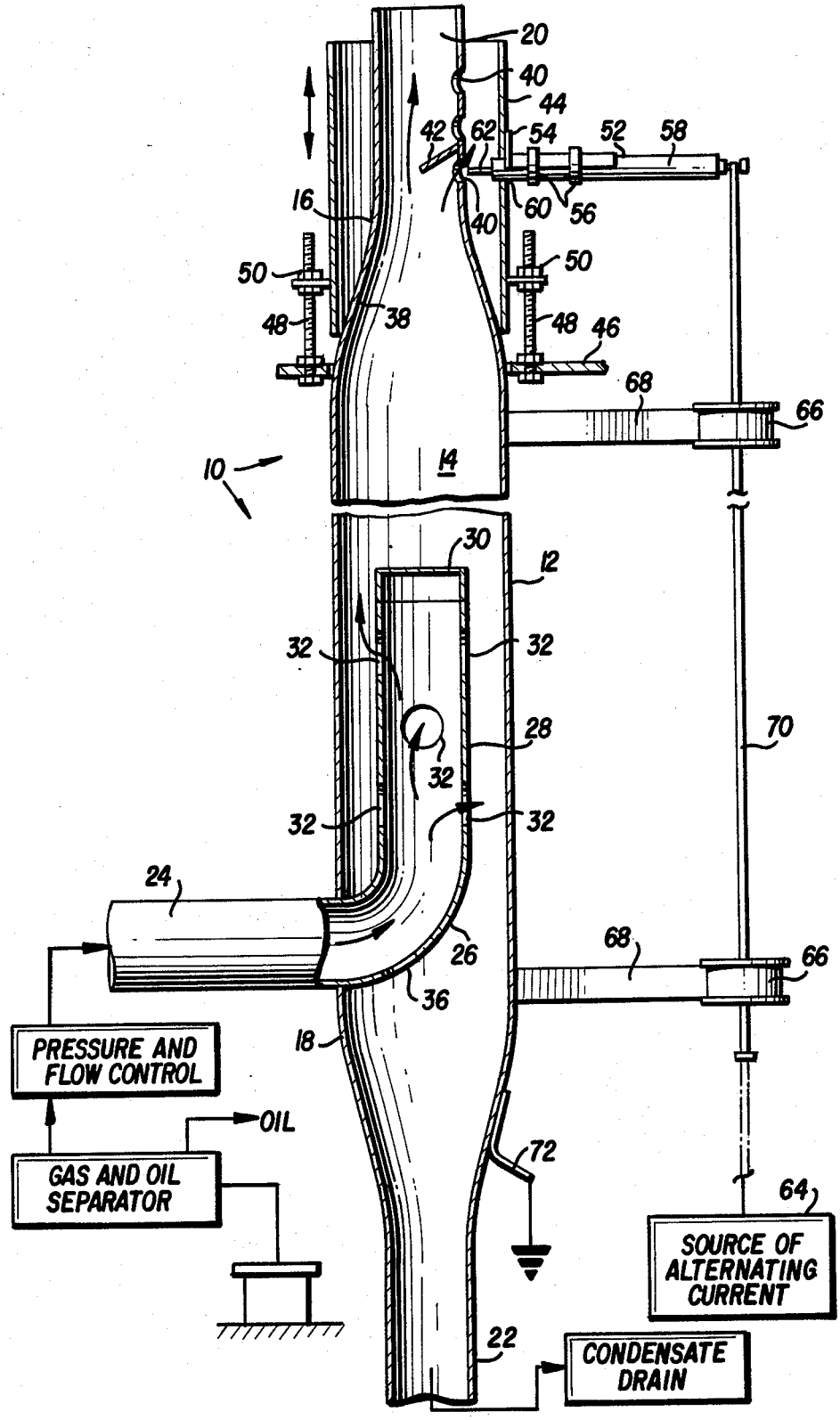
20
40
44
42
62
54
52
58
16
40
60
56
50
50
48
38
48
46
68
66
10
14
30
12
32
32
28
70
32
32
32
24
26
68
66
36
18
PRESSURE AND FLOW CONTROL
OIL
GAS AND OIL SEPARATOR
72
64
SOURCE OF ALTERNATING CURRENT
22
CONDENSATE DRAIN

METHOD AND APPARATUS FOR IGNITING FLARE GAS

TECHNICAL FIELD

The invention is related to methods and apparatuses for igniting hydrocarbon gases. More particularly, the invention concerns such methods and apparatuses for use in igniting flare gas at the head of an oil well or at various points in an oil refinery.

BACKGROUND ART

During the production of oil from an oil well, the oil typically is passed through a suitable separator for removing entrained gases. When it is economically attractive to collect such gases for use as fuel or for other purposes, such collection can be done; however, in many cases, economic conditions require that the well operator dispose of such gases. To prevent the discharge of noxious gases directly into the atmosphere, it has been the practice for many years simply to burn or flare the gases at a location near the well head. Similarly, when such gases are generated during refining of oil, they can be flared at appropriate locations to the refinery. Various methods and apparatuses have been developed over the years for igniting such gases.

A number of problems have been encountered in use of such prior art methods and apparatuses. For example, the ambient winds at the location of the well or refinery may be such that maintaining combustion of the flare gas is relatively difficult. In some cases, the gases to be ignited include a considerable quantity of entrained condensates of water and hydrocarbons so that the igniting electrode used in many systems becomes carbonized or gummed up with the partial combustion products produced during local evaporation and combustion of such condensates. Another difficulty with some prior art methods and apparatuses is that a separate source of combustible gas is required for the purpose of producing a pilot flame which will ignite the flare when gas is released from the well head or refinery. The need for such a separate source of gas results in unwanted complications for many applications.

DISCLOSURE OF THE INVENTION

The primary object of the present invention is to provide a simple, reliable method and an apparatus for igniting gas associated with the production or refinement of oil and gas.

Another object of the invention is to provide such a method and an apparatus in which entrained condensate is removed from the gas prior to ignition.

Yet another object of the invention is to provide such a method and an apparatus in which a separate source of fuel gas is not required to produce a pilot flame for igniting the gas.

A further object of the invention is to provide such an apparatus including an ignition electrode which is supported on an electrically insulating base so as to minimize thermal deformation of the electrode during use.

Still another object of the present invention is to provide such a method and an apparatus in which ignition of a pilot flame and subsequent ignition of the flare are ensured under conditions of high prevailing winds.

These objectives of the invention are given only by way of example. Thus, other desirable objectives and advantages inherently achieved by the disclosed invention may occur or become apparent to those skilled in the art. Nonetheless, the scope of the invention is to be limited only by the appended claims.

The improved apparatus for igniting hydrocarbon gases in accordance with the invention comprises an upwardly extending, elongated conduit which defines an interior chamber having upper and lower portions, the upper portion of the chamber having an open end. An inlet conduit for gases to be ignited extends into the chamber, preferably at its bottom portion, the cross-sectional area of the inlet conduit being substantially smaller than that of the chamber so that the gases expand upon entry into the chamber. In accordance with the preferred embodiment, means are located within the chamber and connected to the inlet conduit for receiving such a flow of gases and for causing vapors entrained in the gases to form condensate which moves downwardly in the chamber. Means are provided for withdrawing from the chamber a portion of these gases as the flow moves upwardly toward the open end of the chamber. Surrounding the chamber are means for receiving the withdrawn portion and for directing it upwardly toward the open-end of the chamber. Finally, means are provided for igniting the withdrawn portion so that a pilot flame is established to ignite the remainder of the gases flowing through the open end.

The means for causing formation of condensates comprises an upwardly projecting extension of the inlet conduit within the chamber, this extension preferably being closed at its upper end and having a plurality of laterally opening discharge apertures through which the gases are released toward the interior wall of the chamber for expansion and formation of condensate. Gases for formation of a pilot flame are withdrawn through a further plurality of laterally opening discharge apertures formed through the elongated conduit at its upper portion. To ensure that a portion of the gases is withdrawn for a pilot flame, means are provided for deflecting such a portion from the upwardly flowing gases through at least one of these additional apertures. Gases flowing through the additional apertures are received within and guided by a cylindrical sleeve or wind bonnet which at least partially surrounds the upper portion of the conduit. The sleeve is spaced radially from the upper portion and extends upwardly toward the open end of the chamber. The axial position of the sleeve can be adjusted to vary the opening between the sleeve and the conduit at the lower end of the sleeve; so that the flow of combustion air can be controlled into the space defined between the sleeve and the upper portion of the conduit. The ignitor preferably is attached to the wind bonnet and extends into the space between the wind bonnet and conduit in position to ignite the pilot flame. Preferably, the ignitor comprises an electrically insulating bushing which extends through an aperture in the wind bonnet and a spark electrode extending through the bushing toward the upper portion of the conduit. In operation, an electrical arc is established between the electrode and the upper portion of the conduit to ignite the pilot flame.

In accordance with the method of the invention, an upwardly extending, elongated conduit is provided for defining an interior chamber, the conduit having upper and lower portions and the upper portion having an open end. An inlet conduit is provided for gases to be ignited, the inlet conduit extending into the chamber and the cross-sectional area of the inlet conduit being substantially smaller than that of the chamber. A flow of gases is introduced into the chamber and expanded there. Preferably, the vapors entrained in the gases are caused to form condensates within the chamber so that the condensates move downwardly in the chamber. A portion of the gases are withdrawn from the chamber as the gases move upwardly toward the open end. This portion of the gases is mixed with air to form a combustible mixture and directed upwardly toward the open end of the chamber. The mixture is ignited to form a pilot flame near the open end to ignite the remainder of the gases flowing through the conduit. Preferably, the initial flow of gas is introduced into the chamber at its lower portion and the gases for formation of the pilot flame are withdrawn from the chamber at its upper portion.

BRIEF DESCRIPTION OF THE DRAWING

The single FIGURE shows an elevation view, partially in section and partially schematic, of an apparatus according to the present invention.

BEST MODE FOR CARRYING OUT THE INVENTION

A flare ignitor 10 according to the invention is illustrated in the FIGURE. Those skilled in the art will understand from the FIGURE that ignitor 10 comprises an upwardly extending, elongated conduit 12 which defines an interior chamber 14. Conduit 12 may be made from a suitable material such as steel and comprises an upper portion 16 and a lower portion 18, the upper portion 16 and chamber 14 having an open upper end 20. The lower end 22 of conduit 12 extends downwardly either into the soil at the location of the flare pit associated with an oil well or refinery (not shown), or into a suitable closed receptacle (not shown). Condensates formed within chamber 14 thus are permitted to flow downwardly within conduit 12; whereas, gas is prevented from entering or leaving chamber 14 through lower end 22.

As shown schematically in the FIGURE, oil and gas leaving an oil well head or a location within a refinery are directed through a gas and oil separator from which gases and some entrained vapors flow through a pressure and flow control before reaching the inlet conduit 24 for the ignitor 10. Conduit 24 extends into chamber 14, preferably at lower portion 18, and then bends upwardly at elbow 26 to form an upwardly projecting extension 28. The upper end of extension 28 preferably is closed by a suitable cap 30. Gases flowing through conduit 24–28 are caused to flow through laterally opening discharge apertures 32 in the wall of conduit 24–28, so that the gases are directed toward and impinge upon the interior walls of chamber 14. As the gases expand within chamber 14 and contact the relatively cool walls of extension 28 and conduit 12, at least some of the entrained water and hydrocarbon vapors are caused to condense and the resulting condensates flow downwardly toward lower end 22. Any condensate which forms inside extension 28 passes into chamber 14 through a downwardly opening aperture 36 provided at elbow 28.

Preferably, apertures 32 and 36 are sized so that there is not an excessive buildup of pressure within upwardly projecting extension 28. An increase in pressure at this location of more than, say, one or two psi would interfere with the proper operation of the pressure and flow control positioned upstream of inlet conduit 24. To avoid such excessive pressure buildup, the combined flow areas of apertures 32 and 36 should be approximately equal to the flow area of inlet conduit 24. To provide adequate expansion of the gases flowing through apertures 32 and 36, the inside diameter of conduit 12 surrounding extension 28 preferably should be at least twice the inside diameter of inlet conduit 24. Thus, the gases flowing through apertures 32 and 36 will expand considerably as they move upward through chamber 14. This expansion tends to reduce turbulence in the gases and to suppress surges so that a considerably more stable flow of gas is achieved at upper portion 16. The reduction of turbulence and suppression of surges is a particularly significant function of chamber 14 since the pressure and flow control typically used in such systems releases gases into inlet conduit 24 only periodically when a sufficient gas pressure has built up. Thus, the gas flow through conduit 24 tends to come in pulses rather than in a steady stream.

Upper portion 16 of conduit 12 preferably comprises a necked down section 38 which reduces the cross-sectional area of chamber 14 to a magnitude approximately equal to that of inlet conduit 24. The smooth reduction in area achieved with portion 28 causes the velocity of the gases to increase without introducing unwanted turbulence. Upper portion 16 also comprises a plurality of laterally opening, vertically spaced discharge apertures 40 through which a portion of the gases flowing upward within chamber 14 is withdrawn to the exterior of conduit 12. The combined cross-sectional area of apertures 40 preferably is less than one-half the cross-sectional area of inlet pipe 24. To ensure that a sufficient portion of the gases moving upwardly within chamber 14 passes through apertures 40 to the exterior of conduit 12, a downwardly and inwardly projecting deflection plate 42 is provided above at least one of apertures 40 to direct a portion of the gases outwardly through the underlying aperture 40. It would also be possible within the scope of the invention, to provide conduit 12 with a constant cross-sectional area at its upper portion 16 and to increase the size of deflection plate 42 as necessary to ensure that a sufficient quantity of gas is deflected through at least one of apertures 40.

Surrounding upper portion 16 is a cylindrical metal sleeve or wind bonnet 44 of about the same diameter as the central portion of conduit 12. The lower end of wind bonnet 44 is radially and axially spaced from necked down portion 38. Wind bonnet 44 is supported on a suitable bracket 46, shown fragmentarily, by means of a plurality of adjustment screws and nuts 48,50. By this means, the axial position of sleeve 46 can be adjusted as necessary relative to necked down portion 38 to change the clearance between wind bonnet 44 and conduit 12 so that an appropriate amount of combustion air can be supplied to the space between conduit 12 and wind bonnet 44 for a pilot flame. Preferably, open end 20 of chamber 14 is positioned somewhat above the upper edge of wind bonnet 44.

An ignitor 52 is mounted on wind bonnet 44 by means of a suitable bracket 54 welded to the wind bonnet, the bracket being attached to ignitor 52 by means of suitable clamps 56. Ignitor 52 comprises an elongated sleeve or bushing 58 of electrically insulating material such as ceramic. Sleeve 58 is fitted snuggly through an opening 60 provided in the wall of wind bonnet 44. An ignition electrode 62 extends through the axial center of sleeve 58 to a location preferably just opposite the lowermost one of apertures 40. A source of alternating or pulsing electrical current 64 is connected to electrode 62 so that a pulsating arc or spark is formed between electrode 62 and conduit 12 in position to ignite gases flowing through apertures 40. Because electrode 62 is supported over most of its length by sleeve 58, it tends to undergo little thermal deformation during use, thereby minimizing the likelihood of arcing to wind bonnet 44 rather than conduit 12. A plurality of electrical insulators 66 are supported by brackets 68 welded to conduit 12 in position to support the input line 70 for electrode 62. Preferably, line 70 is held about 6 inches from conduit 12. Finally, a ground connector 72 is provided on conduit 12 to complete the electrical circuit.

In operation, gases from the well head or refinery are directed through inlet conduit 24 and pass upwardly into extension 28 from which they are discharged through apertures 32 to expand within chamber 14. Condensate formed within extension 28 and chamber 14 flows downwardly toward lower end 22. The gases continue to flow upwardly through necked down portion 38 where their velocity increases. A portion of the gases is withdrawn from chamber 14 through one or more of apertures 40 and ignited within wind bonnet 44 by the arc formed between electrode 62 and conduit 12. The resulting pilot flame burns upwardly toward the open end 20 of conduit 12 and ignites the remainder of the gases flowing upward from chamber 14. Because of the relatively smooth flow through upper portion 16, pilot ignition is reliable and flame interruptions are rather rare while gas is flowing through inlet conduit 24. Preferably, electrode 62 is continuously sparking so that the ignitor will be ready to ignite a pilot flame as soon as flow of gases through inlet conduit 24 commences. However, it is also within the scope of the invention to initiate sparking at electrode 62 upon release of gases into inlet conduit 24.

Experimental prototypes of ignitors constructed and operated in accordance with the present invention have been used to ignite flare gases in ambient temperatures ranging from −27 degrees to +104 degrees Fahrenheit and at wind velocities from 0 to 56 miles per hour. Gas flow rates through the ignitors were as much as 74,000 cubic feet per day. Gas inlet pressure ranged from approximately 0.125 to 25 psi. The diameter of inlet pipe 24 was in the range of about 2 inches to about 4 inches. Chamber 14 was from 6 feet to 30 feet in length and from 4 inches to 8 inches in diameter. Upward extension 28 was from 1 foot to 2 feet in length and from 2 inches to 4 inches in diameter. The diameter of apertures 32 was approximately 1 inch. The axial length of necked down portion 38 was from 6 inches to 12 inches and the diameter of apertures 40 was approximately ¼ inch, with the holes being spaced approximately 1 inch center to center from the upper edge of necked down portion 38 to the top of conduit 12. The length of conduit 12 above necked down portion 38 was approximately 1 foot. The diameter of wind bonnet 44 was from about 2 inches to about 3 inches and conduit 12 extended approximately 1 inch above the upper edge of wind bonnet 44. About 2 to 3 inches of axial adjustment were provided for wind bonnet 44.

While my invention has been shown and described with reference to a particular embodiment thereof, those skilled in the art will understand that variations in the form and detail of the apparatus and method may be made without departing from the spirit and scope of my invention.

Having thus described my invention in sufficient detail to enable those skilled in the art to make and use it, I claim as new and desire to secure Letters Patent for:

1. An apparatus for igniting hydrocarbon gases, said apparatus comprising:

an upwardly extending, elongated conduit defining an interior chamber, said conduit having upper and lower portions and said upper portion having an open end;

an inlet conduit for such gases extending into said chamber, the cross-sectional area of said inlet conduit being substantially smaller than that of said chamber;

means, located within said chamber and connected to said inlet conduit to receive the flow of such gases, for causing vapors entrained in said gases to form condensate which moves downwardly in said chamber and for releasing said gases into said chamber for expansion therein;

means for withdrawing from said chamber a portion of said gases as said flow moves upwardly toward said open end;

means for receiving said portion of said gases and directing said portion upwardly toward said open end; and means for igniting said portion of said gases, whereby a pilot flame is established to ignite the remainder of said gases flowing through said open end and wherein said means for causing and releasing comprises an upwardly projecting extension of said inlet conduit within said chamber, said extension being closed at its upper end and having a plurality of laterally opening discharge apertures through which said gases are released toward the interior walls of said chamber.

2. Apparatus according to claim 1, wherein said inlet conduit extends essentially horizontally into said chamber and then bends upwardly to form said extension, said inlet conduit further comprising an aperture opening downwardly into said chamber for draining said condensate.

3. Apparatus according to claim 1, wherein said inlet conduit extends into said chamber at said lower portion.

4. Apparatus according to claim 1, wherein said means for withdrawing comprises a plurality of laterally opening discharge apertures through said elongated conduit at said upper portion and means for deflecting a portion of said gases into at least one of said plurality of apertures.

5. Apparatus according to claim 4, wherein said plurality of apertures are spaced vertically along said upper portion.

6. Apparatus according to claim 4, wherein said upper portion of said elongated conduit has a cross-sectional area substantially smaller than that of said chamber below said upper portion.

7. Apparatus according to claim 1, wherein said means for receiving comprises a cylindrical sleeve at least partially surrounding said upper portion, said sleeve being spaced radially from said upper portion and extending upwardly toward said open end.

8. An apparatus according to claim 7, comprising means for axially adjusting the position of said sleeve with respect to said upper portion for admitting a flow of combustion air into the space defined between said sleeve and said upper portion, whereby said portion of said gases and said flow of combustion air are combined to form a combustible mixture for said pilot flame.

9. An apparatus according to claim 1, wherein said means for receiving and directing comprises a cylindrical wall of electrically conductive material at least partially surrounding said upper portion, said wall being spaced radially from said upper portion; and said means for igniting comprises an aperture in said wall, an electrically insulating sleeve extending through said aperture and a spark electrode extending through said sleeve toward said upper portion.

10. An apparatus for igniting hydrocarbon gases, said apparatus comprising:

an upwardly extending, elongated conduit defining an interior chamber, said conduit having upper and lower portions, said upper portion having an open end;

an inlet conduit for such gases extending into said chamber, the cross-sectional area of said inlet conduit being substantially smaller than that of said chamber whereby said gases expand within said chamber;

means for withdrawing from said chamber a portion of said gases as said flow moves upwardly toward said open end;

means for receiving said portion of said gases and directing said portion upwardly toward said open end; and means for igniting said portion of said gases, whereby a pilot flame is established to ignite the remainder of said gases flowing through said open end.

11. Apparatus according to claim 10, wherein said inlet conduit extends into said chamber at said lower portion.

12. Apparatus according to claim 10, wherein said means for withdrawing comprises a plurality of laterally opening discharge apertures through said elongated conduit at said upper portion and means for deflecting a portion of said gases into at least one of said plurality of apertures.

13. Apparatus according to claim 12, wherein said plurality of apertures are spaced vertically along said upper portion.

14. Apparatus according to claim 12, wherein said upper portion of said elongated conduit has a cross-sectional area substantially smaller than that of said chamber below said upper portion.

15. Apparatus according to claim 10, wherein said means for receiving comprises a cylindrical sleeve at least partially surrounding said upper portion, said sleeve being spaced radially from said upper portion and extending upwardly toward said open end.

16. An apparatus for igniting hydrocarbon gases, said apparatus comprising:

an upwardly extending, elongated conduit defining an interior chamber, said conduit having upper and lower portions, said upper portion having an open end;

an inlet conduit for such gases extending into said chamber, the cross-sectional area of said inlet conduit being substantially smaller than that of said chamber whereby said gases expand within said chamber;

means for withdrawing from said chamber a portion of said gases as said flow moves upwardly toward said open end;

means for receiving said portion of said gases and directing said portion upwardly toward said open end; and means for igniting said portion of said gases, whereby a pilot flame is established to ignite the remainder of said gases flowing through said open end wherein said means for receiving comprises a cylindrical sleeve at least partially surrounding said upper portion, said sleeve being spaced radially from said upper portion and extending upwardly toward said open end; and further comprising means for axially adjusting the position of said sleeve with respect to said upper portion for admitting a flow of combustion air into the space defined between said sleeve and said upper portion, whereby said portion of said gases and said flow of combustion air are combined to form a combustible mixture for said pilot flame.

17. An apparatus for igniting hydrocarbon gases, said apparatus comprising:

an upwardly extending, elongated conduit defining an interior chamber, said conduit having upper and lower portions, said upper portion having an open end;

an inlet conduit for such gases extending into said chamber, the cross-sectional area of said inlet conduit being substantially smaller than that of said chamber whereby said gases expand within said chamber;

means for withdrawing from said chamber a portion of said gases as said flow moves upwardly toward said open end;

means for receiving said portion of said gases and directing said portion upwardly toward said open end; and means for igniting said portion of said gases, whereby a pilot flame is established to ignite the remainder of said gases flowing through said open end wherein said means for receiving and directing comprises a cylindrical wall of electrically conductive material at least partially surrounding said upper portion, said wall being spaced radially from said upper portion; and said means for igniting comprises an aperture in said wall, an electrically insulating sleeve extending through said aperture and a spark electrode extending through said sleeve toward said upper portion.

18. A method for igniting hydrocarbon gases, said method comprising the steps of:

providing an upwardly extending, elongated conduit defining an interior chamber, said conduit having upper and lower portions and said upper portion having an open end;

providing an inlet conduit for such gases extending into said chamber, the cross-sectional area of said inlet conduit being substantially smaller than that of said chamber;

introducing a flow of such gases into said chamber;

within said chamber causing vapors entrained in said gases to form condensate which moves downwardly in said chamber;

expanding said gases within said chamber;

withdrawing a portion of said gases as said flow moves upwardly toward said open end;

mixing said portion of said gas with air to form a combustible mixture;

directing said mixture upwardly toward said open end; and igniting said mixture to form a pilot flame at said open end to ignite the remainder of said gases flowing through said upper end.

19. A method according to claim 18, wherein said flow of gases is introduced into said chamber at said lower portion.

20. A method according to claim 18, wherein said withdrawing occurs at said upper portion of said chamber.

21. A method according to claim 18, wherein said flow of gases is introduced into said chamber at said lower portion.

22. An improved method for igniting hydrocarbon gases, said method comprising the steps of:

providing an upwardly extending, elongated conduit defining an interior chamber, said conduit having upper and lower portions and said upper portion having an open end;

providing an inlet conduit for such gases extending into said chamber, the cross-sectional area of said inlet conduit being substantially smaller than that of said chamber;

introducing a flow of such gases into said chamber;

expanding said gases within said chamber;

withdrawing a portion of said gases as said flow moves upwardly toward said open end;

mixing said portion of said gas with air to form a combustible mixture;

directing said mixture upwardly toward said open end; and igniting said mixture to form a pilot flame at said open end to ignite the remainder of said gases flowing through said upper end.

23. A method according to claim 22, wherein said withdrawing occurs at said upper portion of said chamber.

24. An improved apparatus for igniting hydrocarbon gases, said apparatus comprising:

an upwardly extending, elongated conduit defining an interior chamber, said conduit having upper and lower portions and said upper portion having an open end;

an inlet conduit for such gases extending into said chamber, the cross-sectional area of said inlet conduit being substantially smaller than that of said chamber;

means, located within said chamber and connected to said inlet conduit to receive the flow of such gases, for causing vapors entrained in said gases to form condensate which moves downwardly in said chamber and for releasing said gases into said chamber for expansion therein;

means for withdrawing from said chamber a portion of said gases as said flow moves upwardly toward said open end;

means for receiving said portion of said gases and directing said portion upwardly toward said open end; and means for igniting said portion of said gas, whereby a pilot flame is established to ignite the remainder of said gases flowing through said open end wherein said means for receiving comprises a cylindrical sleeve at least partially surrounding said upper portion, said sleeve being spaced radially from said upper portion and extending upwardly toward said open end and further comprising means for axially adjusting the position of said sleeve with respect to said upper portion for admitting a flow of combustion air into the space defined between said sleeve and said upper portion, whereby said portion of said gases and said flow of combustion air are combined to form a combustible mixture for said pilot flame.

25. An improved apparatus for igniting hydrocarbon gases, said apparatus comprising:

an upwardly extending, elongated conduit defining an interior chamber, said conduit having upper and lower portions and said upper portion having an open end;

an inlet conduit for such gases extending into said chamber, the cross-sectional area of said inlet conduit being substantially smaller than that of said chamber;

means, located within said chamber and connected to said inlet conduit to receive the flow of such gases, for causing vapors entrained in said gases to form condensate which moves downwardly in said chamber and for releasing said gases into said chamber for expansion therein;

means for withdrawing from said chamber a portion of said gases as said flow moves upwardly toward said open end;

means for receiving said portion of said gases and directing said portion upwardly toward said open end; and means for igniting said portion of said gas, whereby a pilot flame is established to ignite the remainder of said gases flowing through said open end; and wherein said means for receiving and directing comprises a cylindrical wall of electrically conductive material at least partially surrounding said upper portion, said wall being spaced radially from said upper portion; and said means for igniting comprises an aperture in said wall, an electrically insulating sleeve extending through said aperture and a spark electrode extending through said sleeve toward said upper portion.

* * * * *